US010538002B2

(12) United States Patent
Korthuis

(10) Patent No.: US 10,538,002 B2
(45) Date of Patent: Jan. 21, 2020

(54) FOLDING KNIFE WITH REPLACEABLE BLADE AND LOCKING MECHANISM

(71) Applicant: Korcraft LLC, Denver, CO (US)

(72) Inventor: Shane Korthuis, Denver, CO (US)

(73) Assignee: Korcraft LLC, Denver, CO (US)

( * ) Notice: Subject to any disclaimer, the term of this patent is extended or adjusted under 35 U.S.C. 154(b) by 0 days.

(21) Appl. No.: 15/947,556

(22) Filed: Apr. 6, 2018

(65) Prior Publication Data

US 2019/0308335 A1 Oct. 10, 2019

(51) Int. Cl.
*B26B 5/00* (2006.01)
*B26B 1/04* (2006.01)

(52) U.S. Cl.
CPC ..... *B26B 5/006* (2013.01); *B26B 1/04* (2013.01)

(58) Field of Classification Search
CPC ..... B26B 5/006; B26B 1/04
USPC ..... 30/156, 157, 161
See application file for complete search history.

(56) References Cited

U.S. PATENT DOCUMENTS 4,451,982 A 6/1984 Collins
4,918,820 A * 4/1990 Korb ..... B23D 51/01 30/155
6,338,431 B1 1/2002 Onion
6,845,561 B2 1/2005 Timson
7,093,367 B1 * 8/2006 Huang ..... B23D 51/01 30/161
7,536,788 B2 * 5/2009 VanHoy ..... B26B 1/02 30/154
7,913,397 B2 3/2011 Deursen
8,959,779 B2 * 2/2015 Wen ..... B26B 1/046 30/155
9,259,845 B2 * 2/2016 Gringer ..... B26B 5/005
2006/0168818 A1 * 8/2006 Outen ..... B26B 1/046 30/161
2006/0260137 A1 * 11/2006 Flagg ..... B26B 1/044 30/160
2010/0175267 A1 7/2010 Seber et al.
2010/0180450 A1 * 7/2010 Van Deursen ..... B26B 5/001 30/162
2012/0324738 A1 * 12/2012 Chu ..... B26B 1/04 30/160
2017/0266822 A1 9/2017 Scalise

OTHER PUBLICATIONS

3COIL—The home of tiny knives, Website [Online]; 3 Coil [Retrieved Jul. 27, 2018] Retrieved from the Internet http://3coil.com/ [Attachment].
Artifact Solid State Multi-tool, Website [Online], Gerber Gear [Retrieved Jul. 27, 2018], Retrieved from the Internet https://www.gerbergear.com/Multi-Tools/Solid-State/Artifact_22-41770 [Attachment].

(Continued)

*Primary Examiner* — Hwei-Siu C Payer
(74) *Attorney, Agent, or Firm* — VOZ Patents, LLC.

(57) ABSTRACT

A replaceable-blade folding knife configured for ease of use and ease of transportation in a pocket, bag, purse or otherwise. Embodiments of the present invention allow a user to alternatively open and close the folding knife of the present invention using a single hand. Embodiments of the present invention allow a user to replace a blade with commonly available blades without the need for specialized tools.

17 Claims, 10 Drawing Sheets

(56) References Cited

OTHER PUBLICATIONS

Gerber EAB Pocket Knife—Folding Gerber Gear, website [Online], GerberGear.com [Retrieved Jul. 27, 2018], Retrieved from the Internet https://www.gerbergear.com/Knives/Folding/EAB-Pocket-Knife_22-41830. [Attachment].

Stanley 4-14 in. Pocket Knife with Rotating Blade-10-049—[Online], The Home Depot [Retrieved Jul. 27, 2018] Retrieved from the Internet https://www.homedepot.com/p/Stanley-4-1-4-in-Pocket-Knife-with-Rotating-Blade-10-049/203771308 [Attachment].

Superknife (Black) Hobby Utility Folding Razor Knife—SU526 [Online], Knife Center, [Retrieved Jul. 27, 2018] Retrieved from the Internet https://www.knifecenter.com/item/SU526/superknife-black-hobby-utility-folding-razor [Attachment].

Vital Pocket Folder Folding Knife, Website [Online], Gerber Gear [Retrieved Jul. 27, 2018], Retrieved from the Internet; https://www.gerbergear.com/Knives/Folding/Vital-Pocket-Folder_31-002736 [Attachment].

* cited by examiner

FOLDING KNIFE WITH REPLACEABLE BLADE AND LOCKING MECHANISM

FIELD OF THE INVENTION

The present invention is directed to a folding knife having a rotational blade action which in certain embodiments allows single-handed actuation. Certain embodiments of the present invention allow the replacement of a blade in the event the blade becomes dull, or a different blade configuration is desired for various tasks.

BACKGROUND OF THE INVENTION

The folding knife has become a preferred utility cutting tool for many. A folding knife allows a certain level of safety from unintended harm when stored in a pocket or purse. In a closed configuration, the folding knife mitigates self-inflicted injury when a user reaches blindly into a pocket or purse to retrieve the knife. Furthermore, a folding knife, safely stored in a pocket or purse, allows increased discretion versus fixed blade knives which may necessitate the user to wear the knife on a belt or other external article in a visible fashion.

Cutting tools are useful for a variety of purposes, including opening packages, self-defense, arts and crafts, and first-aid purposes. In general, however a cutting tool adapted for arts and crafts, may not provide desired utility for first-aid. As such, a certain blade configuration may be desired for a particular purpose.

The inventor has identified a need for a folding knife which offers portability and allows a user to interchangeably replace a blade without the need for specialized tools.

SUMMARY OF THE INVENTION

Existing folding blade knives typically have a blade permanently affixed to the assembly of the folding knife, or that would require special tools to remove the blade. Existing folding knives—such as those disclosed by U.S. Pat. No. 6,338,431 to Onion ("Onion") and U.S. Pat. No. 4,451,982 to Collins ("Collins"), each herein incorporated by references in their entirety for all purposes—are not adapted for ease of replacement of the blade. As such, if cutting edge of the blade becomes dull, the user must sharpen the blade using specialty tools such as a whet stone or other specialized knife sharpening tool. Sharpening a blade is a specialized skill that is tedious and challenging for some individuals. As such, many folding knives become dull and are not sharpened, limiting the functionality of the blade.

It is an aspect of certain embodiments of the present invention to provide a portable folding knife allowing rapid replacement of the blade. The blade replacement functionality of the present invention allows an individual to replace a blade once it has dulled without the use of specialty tools. By using standardized replacement blades, such as those generically referred to by some as X-Acto® blades, a user can cost-effectively replace a dulled blade with a new sharp blade. This replacement strategy negates the need for specialized sharpening tools, specialized skill in sharpening a blade, and specialized tools for disassembling a knife.

It will be appreciated that existing folding knives, such as those disclosed by Onion, are adapted for use of a particular blade, which is installed by an original equipment manufacturer (OEM). It is an aspect of embodiments of the present invention to allow a user to use a wide variety of blade types, each blade adapted for different purposes. Such blades include utility blades, general purpose blades, curved blades, straight blades, chiseling blades, saw blades, scoring blades, deburring blades, stripping blades, whittling blades, carving blades, and scalpel blades. It will be appreciated that blades not disclosed may be used while in keeping with the scope and spirit of the instant application.

Existing utility knives allow the rapid replacement of the blade, however such utility knives—such as those disclosed by U.S. Patent Publication No. 2010/0175267 to Seber, et al. ("Seber"), U.S. Pat. No. 6,845,561 to Timson ("Timson"), U.S. Pat. No. 7,913,397 to Deursen ("Deursen"), and U.S. Pat. No. 9,259,845 to Gringer et al. ("Gringer"); each herein incorporated by reference in their entirety for all purposes—are adapted for use with a particular type of blade. Furthermore, it is commonly desired for such utility knives to have a handle which a user can grasp with their whole hand. While useful, these replaceable-blade folding knives are often bulky and difficult to carry in one's pocket. Certain embodiments of present invention provide a compact form which is adapted for portability in one's pocket.

Certain embodiments of the present invention are adapted for portability and use in a variety of use-cases. It will be appreciated that a compact replaceable-blade folding knife is useful for hobbyist activities such as arts and crafts, wood carving, and general use. It will be further appreciated that a compact replaceable-blade folding knife is useful in first-aid purposes where weight and size are critical. Such use-cases may include in use for backcountry activities or in-field military operations where access to proper medical care is not readily available. As such, an individual would not be restricted to carrying multiple knives, each having a specific blade. In light of the present invention, an individual could carry a single replaceable-blade folding knife having a variety of purposes based upon the blades carried.

It is a further aspect of certain embodiments of the present invention to provide a single-handed use design which allows a user to actuate a folding blade knife between a closed configuration and an open configuration with a single hand. Existing knives designed for single-hand deployment can be difficult to actuate, while others can potentially increase the chance of injury to a user. Certain existing single-hand operation knives—such as disclosed by U.S. Pat. No. 6,145,202 to Onion ("Onion"), herein incorporated by reference in its entirety for all purposes—use a spring-assist mechanism which uses a torsional spring to enable single-handed use. The spring-assist mechanism of Onion relies upon the user deploying the blade radially by a certain distance prior to the spring-assist mechanism completing the movement of the blade to a final open configuration. Certain embodiments of the present invention allow a user to control the full rotational actuation of a folding blade from a fully closed to a fully open configuration.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary. Additional aspects of the present invention will become more readily apparent from the detailed description, particularly when taken together with the drawings, and the claims provided herein.

DETAILED DESCRIPTION OF VARIOUS EMBODIMENTS

Figure 1:
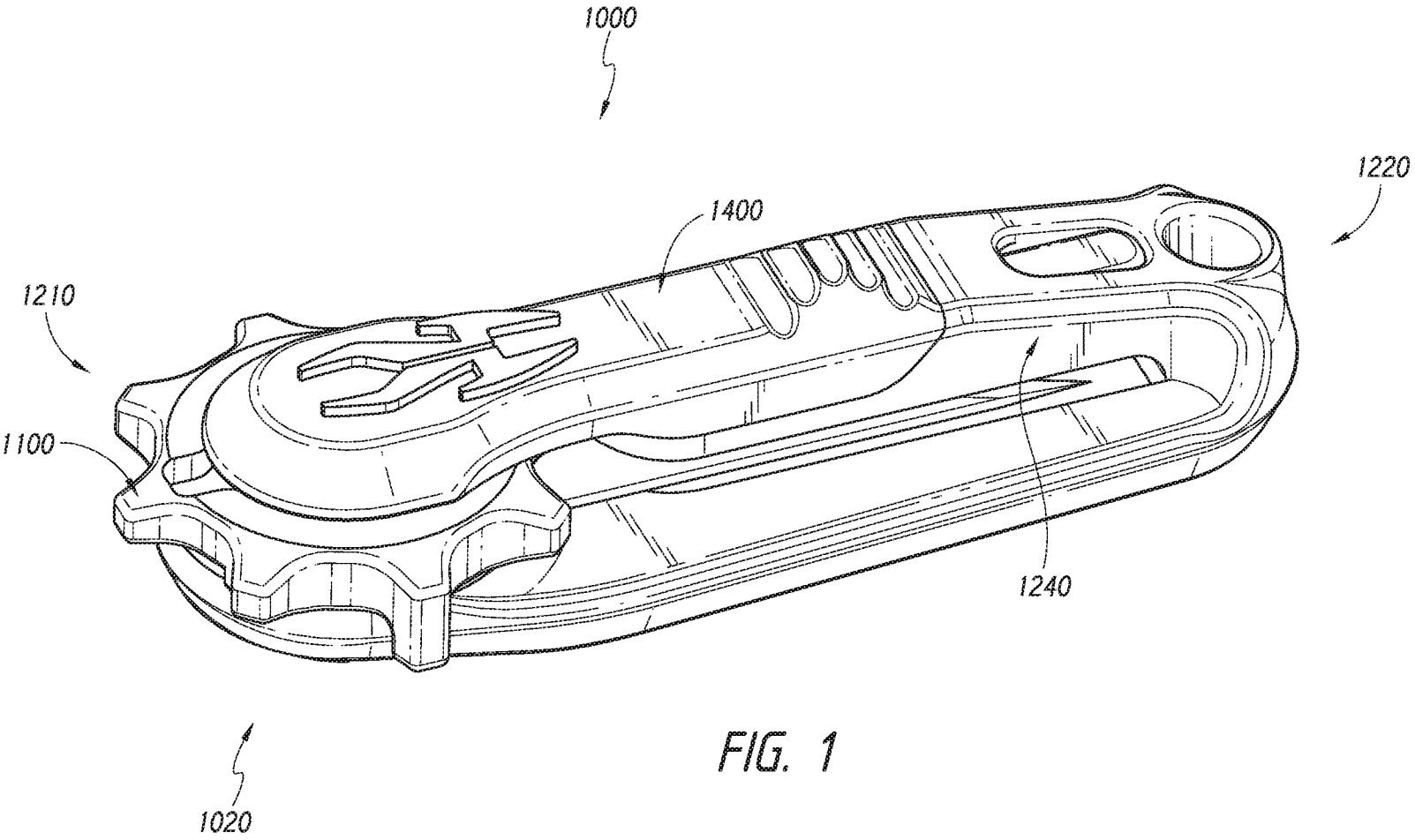
FIG. 1—A perspective view of certain embodiments in a closed configuration
Figure 2:
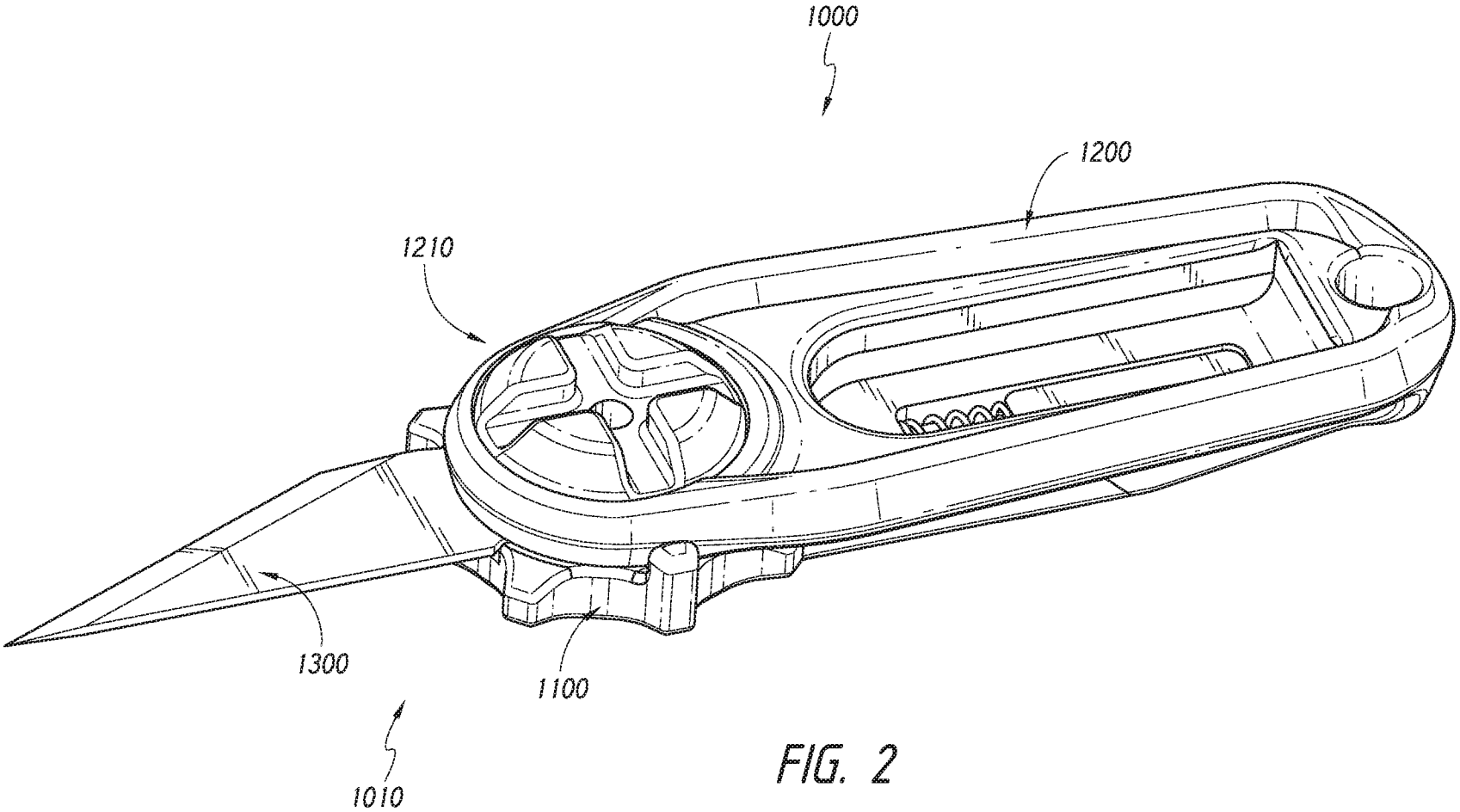
FIG. 2—A perspective view of certain embodiments in an open configuration

Certain embodiments of the present invention comprise a folding knife 1000, as seen in FIG. 1 and FIG. 2, having an actuator 1100 axially affixed to a first end 1210 of a base 1200. The actuator 1100 is rotationally adjustable in relation to the base 1200 and allows for the fixation of a blade 1300 to the actuator. Thus, the rotational adjustment of the actuator 1100 rotates a blade 1300, affixed to the actuator 1100, between an open configuration 1010 and a closed configuration 1020.

Figure 3:
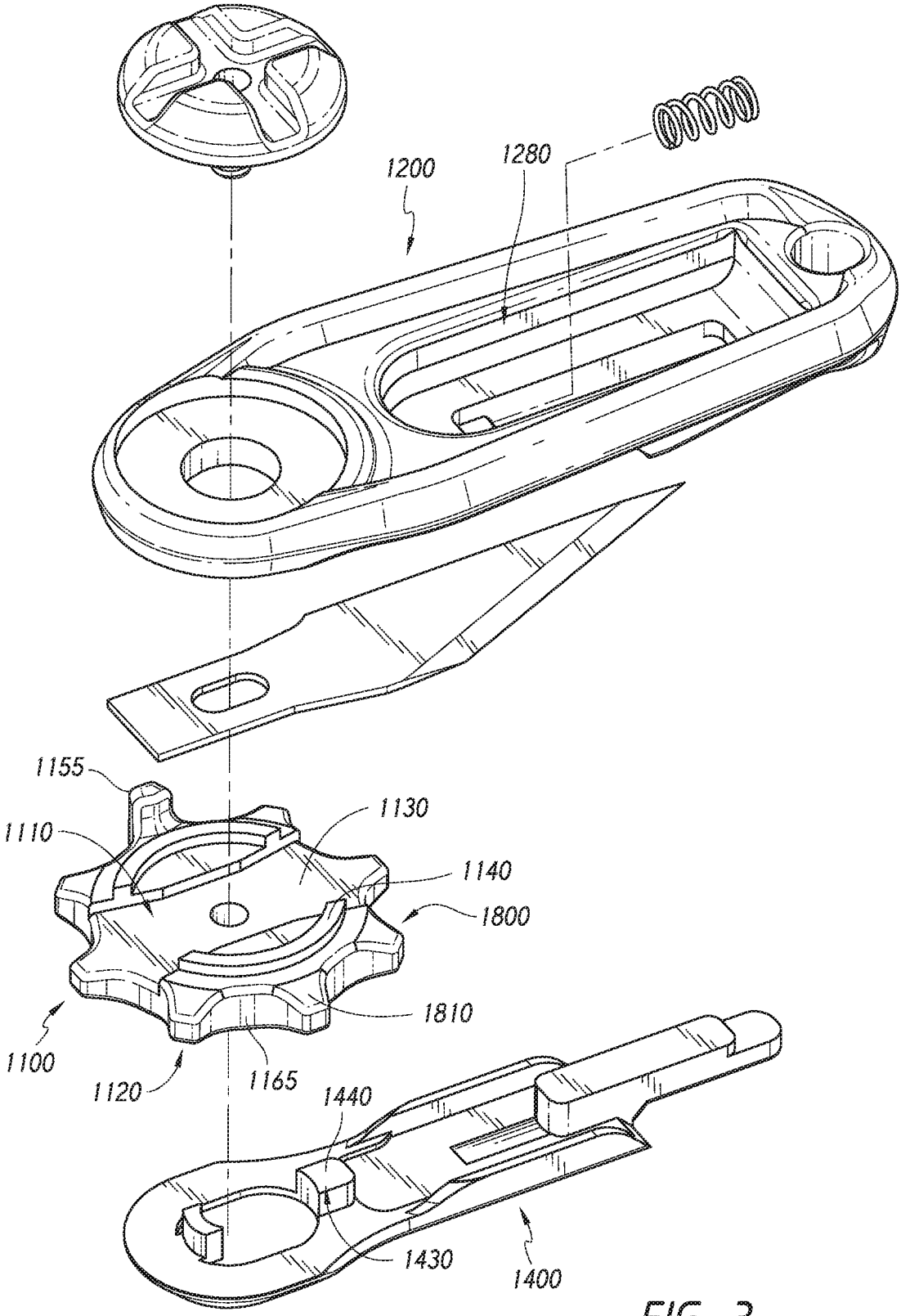
FIG. 3—A perspective exploded view of certain embodiments

Certain embodiments, shown in FIG. 3, comprise an actuator 1100 having a recess 1130 on a first side 1110, wherein the recess 1130 is configured to receive a blade 1300 for increased constraint of the blade 1300 to the actuator 1100. The mating of a blade 1300 with a recess 1130 of an actuator results in the radial adjustment of the actuator 1100 translating to the radial adjustment of the blade 1300. However, it will be appreciated that a recess 1130 configured for receiving a blade 1300 can be consistent with a first side 1110 or a second side 1120 of the actuator while in keeping with the spirit and scope of the present invention.

Figure 4:
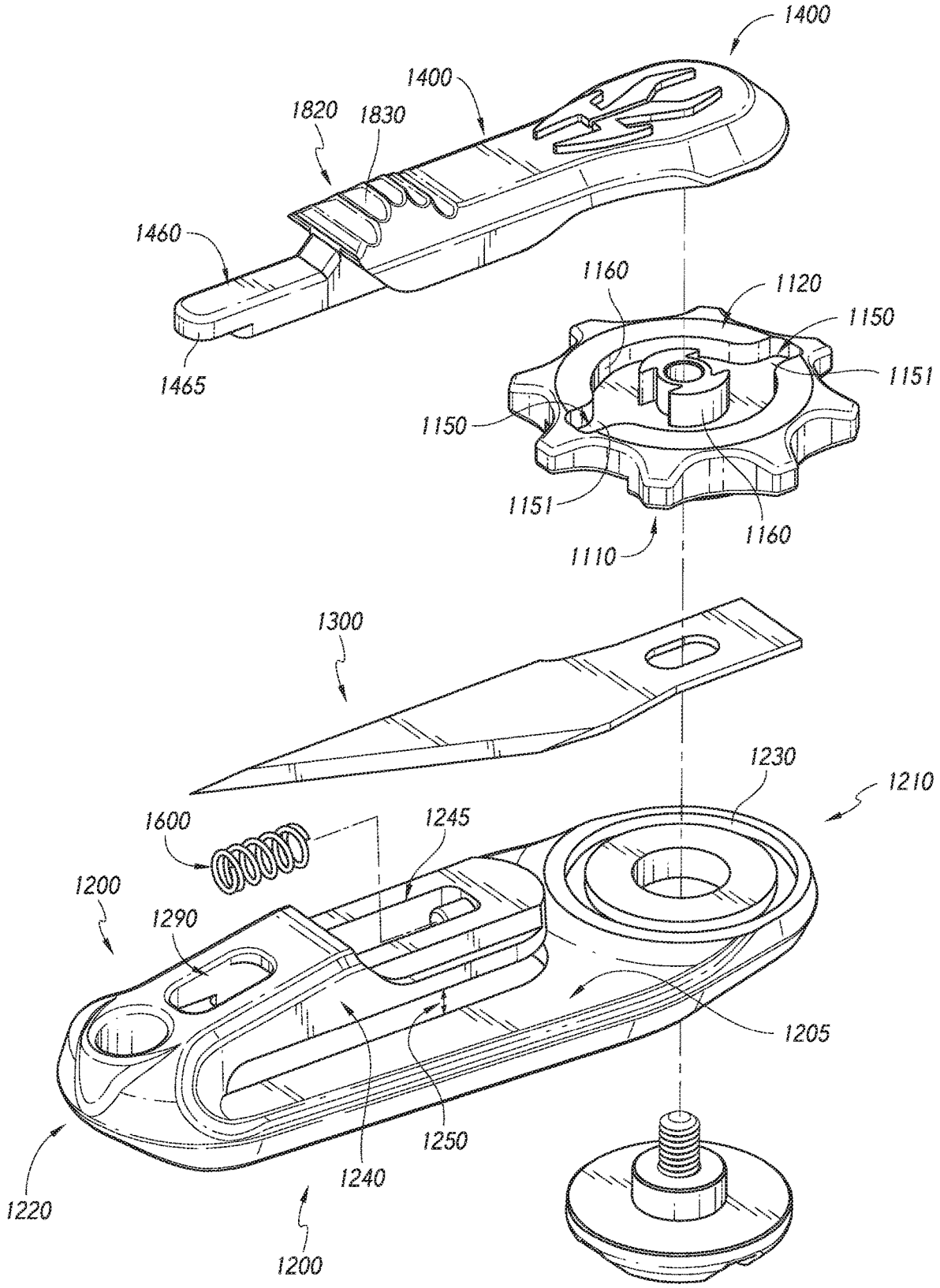
FIG. 4—A perspective exploded view of certain embodiments

Certain embodiments, shown in FIG. 3 and FIG. 4, comprise a base 1200 having a radial feature 1230 at a first end 1210 of the base, and the radial feature 1230 consistent with a first side 1205 of the base. A radial feature 1140 on a first side 1110 of an actuator is configured to engage with the radial feature 1230 of the base. Thus, the actuator 1100 is axially constrained to the base 1200 through the mating of the radial feature 1230 of the base and the radial feature 1140 of the actuator while allowing the radial adjustability of the actuator 1100.

Figure 5:
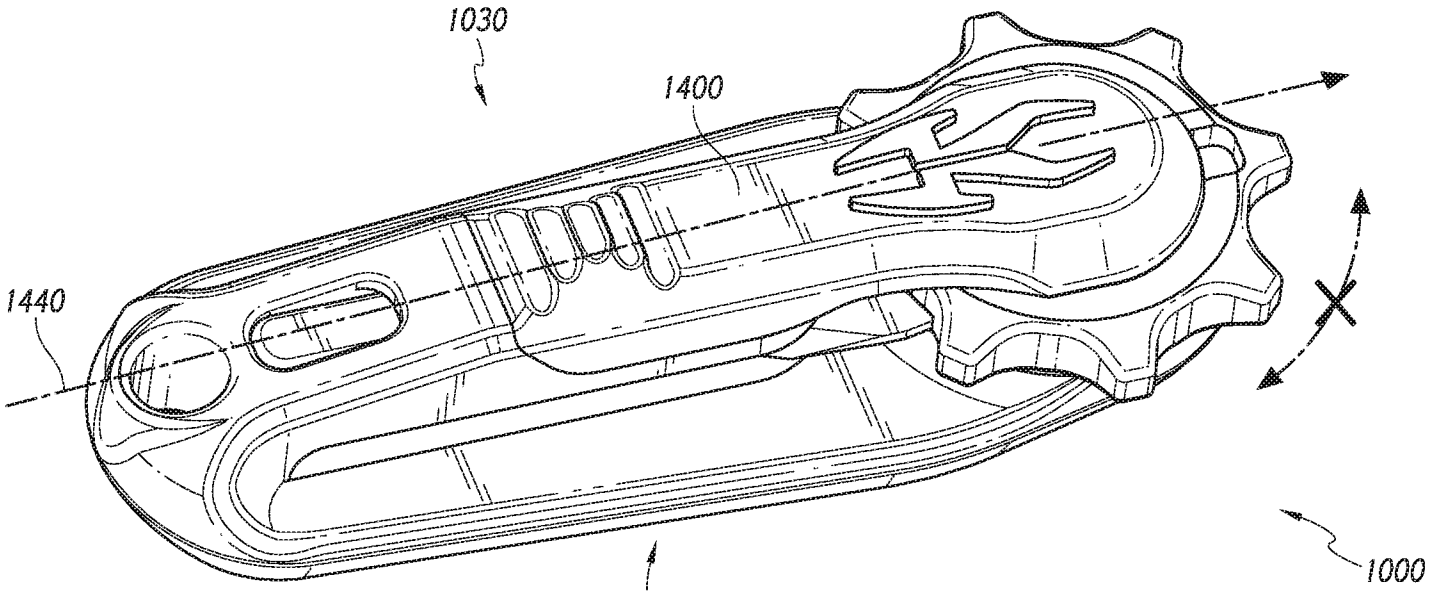
FIG. 5—A perspective view of certain embodiments in a locked/closed configuration FIG. 6—A perspective view of certain embodiments in an unlocked/open configuration FIG. 7—A perspective view of certain embodiments in a locked/open configuration FIG. 8—An exemplary view of an embodiment of a detent mechanism FIG. 9—A cross-sectional side view of an embodiment FIG. 10—A perspective view of an embodiment
Figure 6:
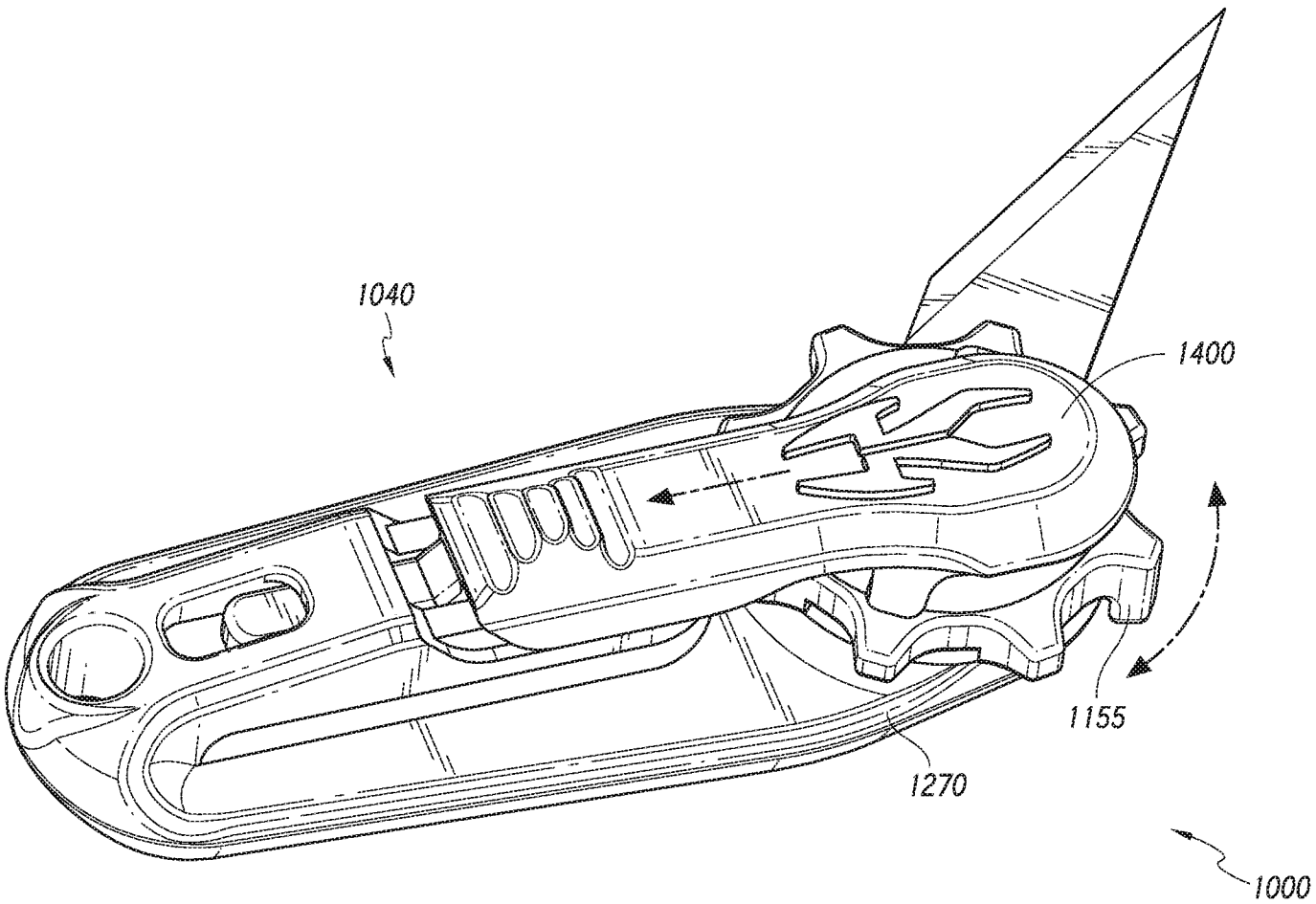
Figure 7:
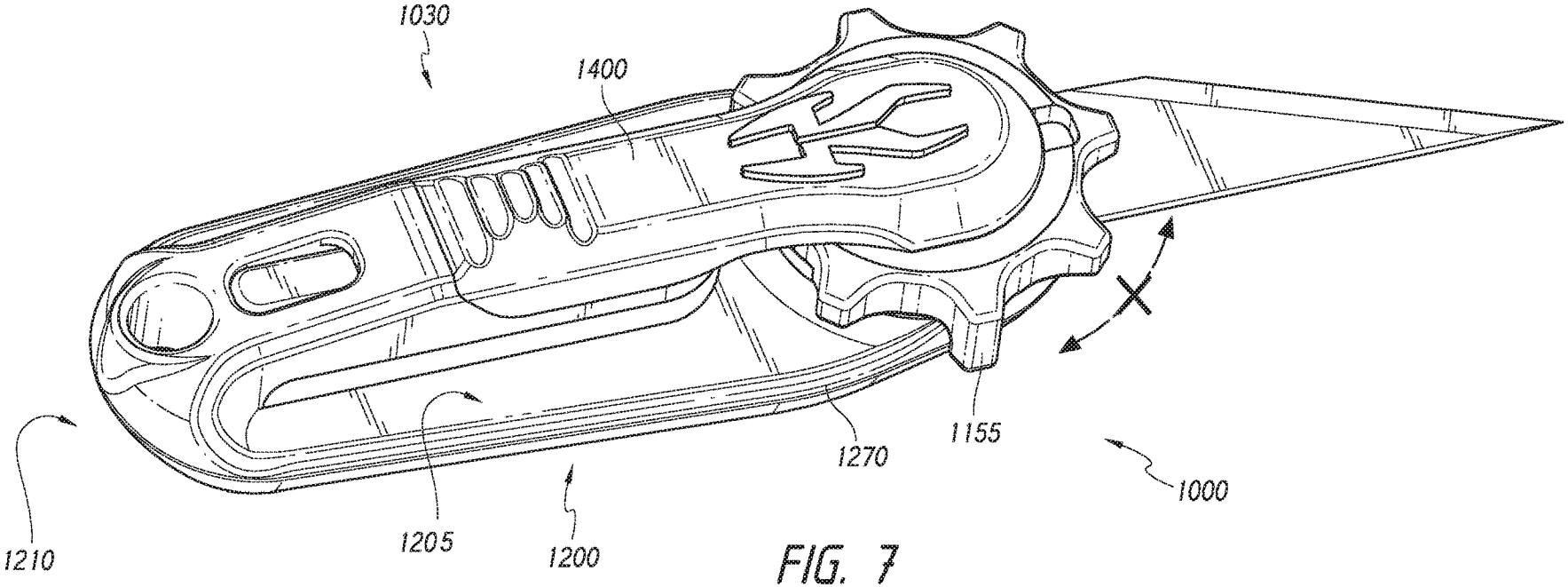

In certain embodiments, shown in FIG. 5-FIG. 7, a release mechanism 1400 is mated with the base 1200 to allow slidable adjustability. The slidable adjustment of the release mechanism 1400 alternatively toggles the folding knife 1000 in a locked configuration 1030 or an unlocked configuration 1040. In certain embodiments, a locking element 1430 of the release mechanism engages with a locking element 1150 of the actuator (shown in FIG. 3-FIG. 4) the folding knife 1000 is in a locked configuration 1030. Alternatively, when the locking element 1430 of the release mechanism is disengaged from the locking element 1150 of the actuator, the folding knife 1000 is in an unlocked configuration 1040 (FIG. 6).

Certain embodiments comprise a release mechanism 1400 which is constrained with the base 1200 to allow slidable adjustability of the release mechanism 1400 in relation to the base 1200. As shown, in FIG. 1-FIG. 7, the release mechanism 1400 is configured to slidably engage and disengage with a locking element 1150 disposed on the actuator. In certain embodiments, the locking element 1150 of the actuator is configured to be consistent with a second side 1120 of the actuator. However, it will be appreciated to those skilled in the art that a locking element 1150 is not restricted to the second side 1120 of the actuator. The release mechanism 1400 comprises a locking element 1430 which is configured to mate with the locking element 1150 of the actuator, wherein the mating of the locking element 1430 of the release mechanism with the locking element 1150 of the actuator results in the radial constraint of the actuator 1100. Although a release mechanism 1400 of certain embodiments, as shown in FIG. 5-FIG. 7, comprises slidable adjustability along an axis 1440, it will be appreciated that a release mechanism 1400 may comprise radial adjustability while in keeping with the spirit and scope of the present invention.

Figure 8:
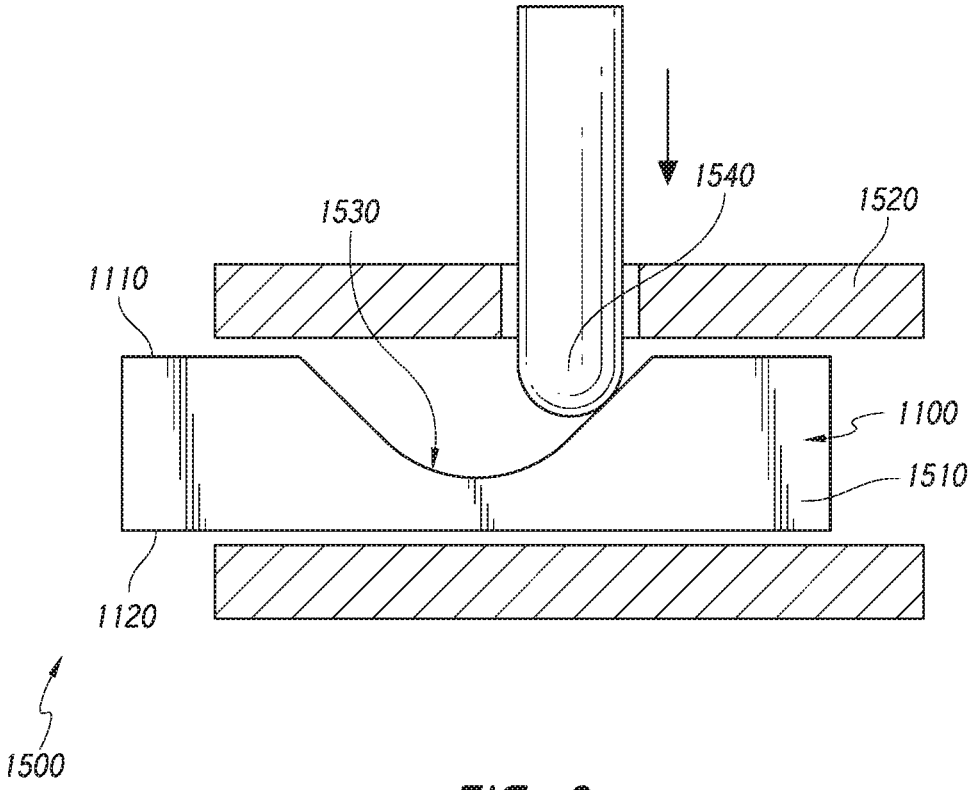

Certain embodiments, shown in FIG. 5-FIG. 7, comprise a release mechanism 1400 which is slidably adjustable to alternatively configure the folding knife 1000 in a locked configuration 1030 or unlocked configuration 1040. In certain embodiments a release mechanism 1400 is slid toward the actuator 1100 in order to unlock the folding knife 1000, while certain embodiments require a release mechanism 1400 to be slid away from the actuator 1100 to unlock the folding knife 1000. Furthermore, certain embodiments comprise a release mechanism 1400 which comprises a detent mechanism 1500, for example as shown in FIG. 8. A detent mechanism 1500, does not require a release mechanism be slidably adjustable. A detent mechanism 1500, in certain embodiments, constrains the radial movement of the actuator 1100 until a sufficient torque or force is applied to the actuator 1100 to overcome the holding torque or holding force of the detent mechanism 1500. A detent mechanism 1500, as described, typically interfaces with a first side 1110 (as shown), or second side 1120 of the actuator. Certain embodiments of a detent mechanism 1500 comprise an indentation 1530 on a first body 1510 and a protrusion 1540 on an opposing second body 1520. The indentation 1530 and the protrusion 1540 typically comprise tapering profiles. The first body 1510 and/or the second body 1520 is flexibly displaceable substantially orthogonally from the opposing body. In certain embodiments, such as those comprising a retractable detent (shown in FIG. 8) or ball detent, it will be appreciated that the protrusion is flexibly displaceable while second body 1520 remains rigid. It will be appreciated that a detent mechanism 1500 of certain embodiments is not limited to being placed consistent to a first side 1110 or second side 1120 of an actuator and may be consistent with an internal radial surface 1160, now referencing FIG. 3-FIG. 4, or an external radial surface 1165 while in keeping with the scope and spirit of the present invention.

Certain embodiments of the present invention comprise an actuator 1100 having a plurality of locking elements 1150. As shown in FIG. 4, a first locking element 1150 and a second locking element 1150 of the actuator are radially offset from one another by 180 degrees. However, it will be appreciated that the locking elements 1150 may be radially offset between 0-359 degrees from one another while keeping in the spirit and scope of the present invention. It will be appreciated that the radial offset of locking elements dictates the positions in which the actuator 1100, and thus a blade 1300 affixed thereto, can be radially constrained to.

Figure 9:
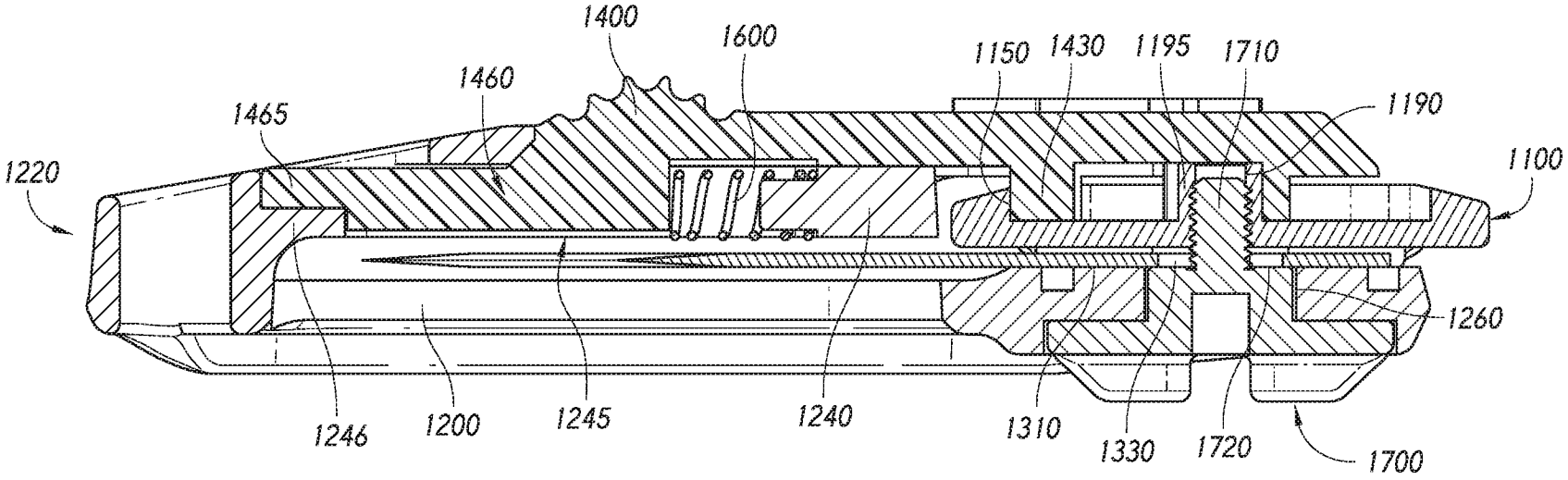

In certain embodiments, shown in FIG. 3-FIG. 4 and FIG. 9, a spring 1600 applies a force to the release mechanism 1400 to bias the release mechanism toward a locked configuration. This bias results in the locking element 1430 of the release mechanism automatically engaging with a locking element 1150 of the actuator when aligned, resulting in a locked configuration. As such, a force must be applied to the release mechanism 1400 in order to disengage the locking element 1430 of the release mechanism from the locking element 1150 of the actuator, thereby placing the folding knife 1000 in an unlocked configuration 1040 (FIG. 6).

Although it is shown in FIG. 3 and FIG. 4 that a locking element 1430 of the release mechanism comprises a key 1440 and the locking element 1150 of the actuator comprises a slot 1151, wherein the key 1440 is configured to mate with the slot 1151, it will be appreciated that other devices and methods known to those skilled in the art may be used to provide radial constraint of the actuator 1100. Thus, it will be appreciated to those skilled in the art to use devices such as a detent, ball detent, pawl, or other such devices to provide radial constraint while keeping in the spirit and scope of the present invention.

In certain embodiments, shown in FIG. 1-FIG. 2, and FIG. 4, the release mechanism 1400 is mated with an arm 1240 affixed to a second end 1220 of the base. The arm 1240 extends toward the first end 1210 of the base and has an offset 1250 between the base 1200 and the arm 1240. The offset 1250 of the arm from the base 1200, in certain embodiments, allows for the rotational displacement of a blade 1300 affixed to the folding knife 1000 when transitioning between a closed configuration 1020 and an open configuration 1010.

Figure 10:
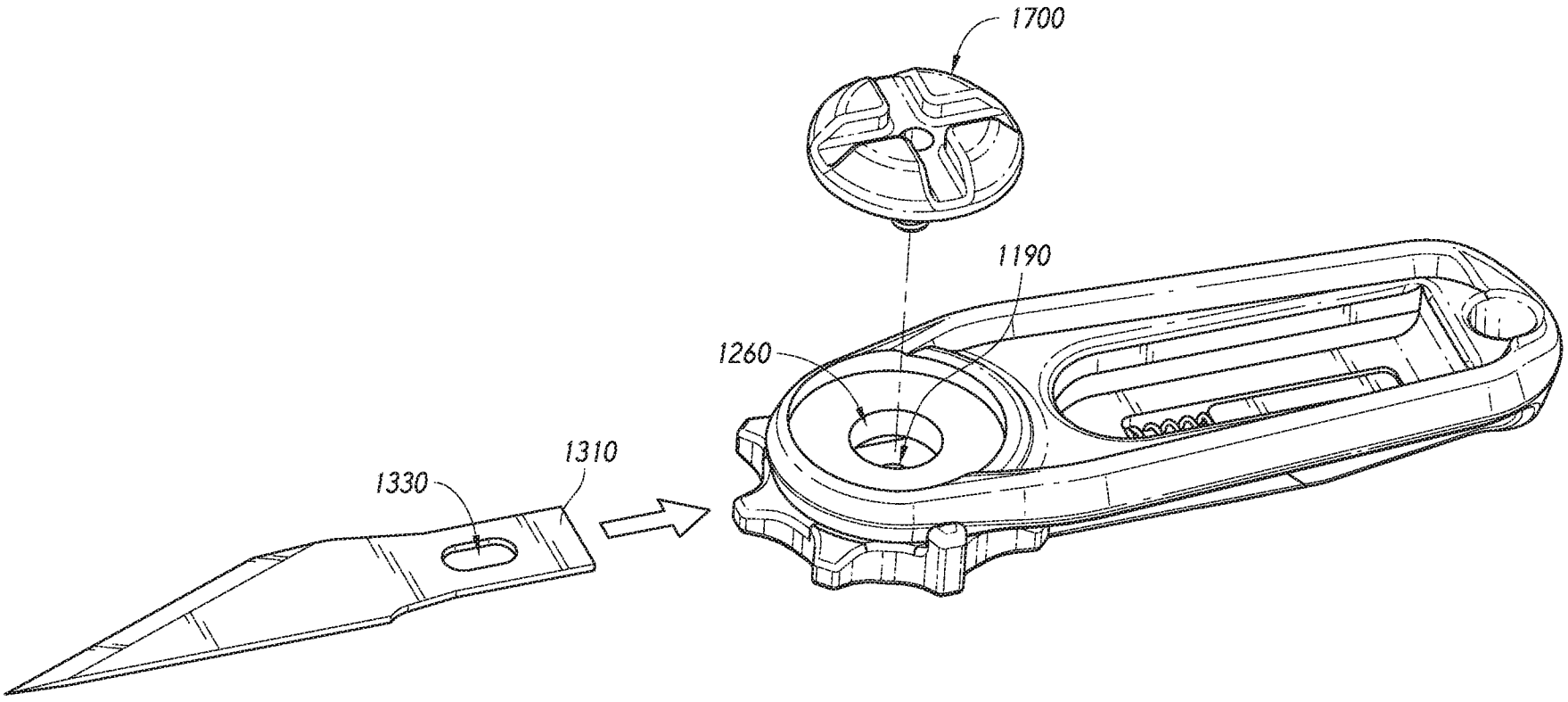

Certain embodiments, seen in FIG. 9-FIG. 10, comprise a blade retainer 1700 which is configured to pass through an aperture 1260 of the base, through an aperture 1330 of a blade mated with the actuator 1100, and into an aperture 1190 of the actuator that comprises a female threaded feature 1195. In doing so, a male threaded feature 1710 of the blade retainer constrains the blade 1300 to the actuator 1100 and limits the movement of the blade 1300 to radial movement consistent with the radial movement of the actuator 1100. In certain embodiments, the blade retainer 1700 further comprises a shoulder 1720 which is configured to abut a first side 1310 of the blade, thereby compressing the blade 1300 between the shoulder 1720 of the blade retainer and the actuator 1100.

Certain embodiments, seen in FIG. 3, comprise an actuator 1100 further comprising a finger engagement feature 1800 on the external radial surface 1165 of the actuator. In certain embodiments, such finger engagement features 1800 comprise a tooth 1810, or a plurality thereof, which radially extend from the external radial surface 1165 of the actuator. It will be appreciated that a finger engagement feature 1800 of certain embodiments is not limited to teeth 1810, and may comprise elements such as knurling, or other friction increasing elements while in keeping with the scope and spirit of the present invention.

In certain embodiments, as seen in FIG. 4, a release mechanism 1400 further comprises a finger engagement feature 1820 on an outer surface of the release mechanism for increased frictional interaction between a finger and the release mechanism 1400. In certain embodiments, the finger engagement feature 1820 of the release mechanism comprises ridges 1830 or an indentation to provide a user increased frictional interaction between a finger and the release mechanism.

Certain embodiments comprise an actuator 1100 further comprising a rotational stop 1155. A rotational stop 1155, as shown in FIG. 3, and FIG. 6-FIG. 7, extends beyond the plane of the first side 1110 of the actuator to interact with an edge 1270 of the base. In such embodiments, the rotational stop 1155 limits the rotational movement of the folding knife to 180 degrees between an open configuration and a closed configuration. However, it will be appreciated that it is not required to limit the rotational movement of the folding knife to 180 degrees, and it may be desired to limit rotational movement to between 1-359 degrees as desired for an intended purpose. It will be appreciated that certain embodiments may comprise a rotational stop 1155, surrounding elements which extend outward from the first side 1205 of the base to interact with the actuator 1100. It will be further appreciated that certain embodiments of a rotational stop 1155 comprise existing methods and mechanisms for the limitation of rotation movement as known to those skilled in the art while in keeping with the scope and spirit of the present invention.

Certain embodiments, shown in FIG. 3, comprise a base 1200 which further comprises a fenestration 1280. The fenestration 1280 provides visual access to the blade 1300 for the inspection of blade presence, blade condition, and blade type. The fenestration 1280 also provides a reduction of material, serving to reduce the weight of the folding 1000.

Certain embodiments of the present invention, seen in FIG. 4 and FIG. 9, comprise a release mechanism 1400 further comprising a tongue 1460 configured to be disposed through a groove 1245 in an arm 1240 of the folding knife. The arm 1240 is affixed to the base 1200 proximal to the second end 1220 of the base 1200 and is offset from the base 1200. To assemble the release mechanism 1400 to the arm 1240, a user can dispose the release mechanism 1400 at an angle between 0-90 degrees in relation to the groove 1245. Once the tongue 1460 is inserted into the groove 1245, the release mechanism 1400 is rotated toward the base until substantially parallel to the groove 1245. Once rotated into a parallel position, the release mechanism 1400 can be indexed toward the second end 1220 of the base, and further engaging a tab 1465 of the tongue with a ledge 1246 of the groove. When the tab 1465 is engaged with the ledge 1246, the release mechanism 1400 cannot be disassembled from the arm. As such, in certain embodiments, when a spring 1600 is disposed between the release mechanism 1400 and the arm 1240, the spring 1600 limits the slidable movement of the release mechanism 1400, thereby preventing the tab 1465 from disengaging from the ledge 1246, thus preventing the disassembly of the release mechanism 1400 from the arm 1240.

Certain embodiments, seen in FIG. 4, comprise a fenestration 1290 consistent with the arm 1240 of the base, wherein the tab 1465 can be viewed through. Thus, the user can identify the status of the tab 1465 through the fenestration 1290 to identify if the folding knife is in a locked or unlocked position.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A replaceable-blade folding knife comprising:

a base;

an arm offset from a first side of the base, attached proximally to a second end of the base, and the arm extending toward a first end of the base;

an actuator comprising a recess;

the actuator further comprising a locking element, the locking element comprising a slot;

a blade retainer comprising a first threaded feature; and a release mechanism having a locking element comprising a key on a first side of the release mechanism, the locking element of the release mechanism configured to engage with the locking element of the actuator, wherein the recess is configured to slidably receive a blade in a direction perpendicular to a second threaded feature of the actuator, and the first threaded feature of the blade retainer is configured to engage with the second threaded feature of the actuator, thereby retaining the blade placed within the recess, wherein a first position of the release mechanism restricts rotational movement of the actuator, and wherein a second position of the release mechanism permits the rotational movement of the actuator.

2. The replaceable-blade folding knife of claim 1, further comprising a spring wherein the spring acts upon the release mechanism and the arm to bias the release mechanism toward a locked configuration.

3. The replaceable-blade folding knife of claim 2, wherein the spring is a compression spring.

4. The replaceable-blade folding knife of claim 1 wherein the mating of the key with the slot constrains the rotational movement of the actuator.

5. The replaceable-blade folding knife of claim 1, wherein the first threaded feature of the blade retainer comprises a male threaded feature.

6. The replaceable-blade folding knife of claim 1, wherein the first threaded feature of the blade retainer comprises a male threaded feature;

the base comprises a first aperture; and the second threaded feature comprises a female threaded feature, wherein the male threaded feature passes through the first aperture of the base, through an aperture of the blade placed within the recess, and engages with the female threaded feature of the actuator, and thereby retains the blade within the recess.

7. The replaceable-blade folding knife of claim 6, wherein the blade retainer further comprises a shoulder, wherein the shoulder is configured to abut a first side of the blade, thereby compressing the blade between the shoulder of the blade retainer and the actuator.

8. The replaceable-blade folding knife of claim 1, wherein the release mechanism further comprises a finger engagement feature.

9. The replaceable-blade folding knife of claim 1, wherein the actuator further comprises a finger engagement feature.

10. The replaceable-blade folding knife of claim 9, wherein the finger engagement feature comprises teeth extending radially outward from the actuator.

11. The replaceable-blade folding knife of claim 1, wherein the actuator further comprises a rotational stop configured to abut a first edge of the base in a closed configuration, and abut a second edge of the base in an open configuration.

12. The replaceable-blade folding knife of claim 1, wherein the actuator is restricted to approximately 180-degrees of rotational motion.

13. The replaceable-blade folding knife of claim 1, wherein the release mechanism is slidably affixed to the arm.

14. The replaceable-blade folding knife of claim 1, wherein the base comprises a radial feature on the first side of the base, proximal to the first end of the base; and the actuator having a first radial feature on a first side thereof configured to engage with the radial feature of the base thereby axially constraining the actuator in relation to the base.

15. The replaceable-blade folding knife of claim 1, wherein the release mechanism is axially slidably adjustable in relation to the base.

16. The replaceable-blade folding knife of claim 1, wherein the release mechanism is rotatively slidably adjustable in relation to the base.

17. The replaceable-blade folding knife of claim 1, further comprising a fenestration.

* * * * *